United States Patent [19]

Askin

[11] 4,057,096

[45] Nov. 8, 1977

[54] STARTING DUMMY BAR POSITIONER FOR CONTINUOUS CASTING OF METALS

[75] Inventor: Kerim Askin, Carrollton, Ga.

[73] Assignee: Southwire Company, Carrollton, Ga.

[21] Appl. No.: 675,340

[22] Filed: Apr. 9, 1976

[51] Int. Cl.[2] ..... B22D 11/06; B22D 11/08

[52] U.S. Cl. ..... 164/49; 164/87; 164/147; 164/426; 335/289

[58] Field of Search ..... 164/146–148, 164/274, 278, 49, 87; 222/594; 335/289; 251/141

[56] References Cited

U.S. PATENT DOCUMENTS 1,270,170 6/1918 Kingsbury ..... 251/141 X 2,561,922 7/1951 Hall ..... 252/141 X

*Primary Examiner*—Robert D. Baldwin

*Attorney, Agent, or Firm*—Van C. Wilks; Herbert M. Hanegan; Stanley L. Tate

[57] ABSTRACT

Method and apparatus for continuously casting molten metal into a rod of indefinite length comprising a rotatable casting wheel having an elongate arcuate molding passageway for receiving molten metal, and a plug which is retained within the passageway by magnetic force for temporarily blocking the passageway at an intermediate position along its length to prevent escape of molten metal from the passageway during initial start-up of the casting operation.

12 Claims, 2 Drawing Figures

STARTING DUMMY BAR POSITIONER FOR CONTINUOUS CASTING OF METALS

BACKGROUND OF THE INVENTION

The continuous casting of molten metal in a peripheral groove around a rotating casting wheel is well known in the metal foundry art. Typically, such an apparatus consists of a rotatable casting drum or wheel having an annular peripheral groove, the outer open side of which is enclosed along a portion of its arcuate length by an overlying endless flexible band or belt to form an elongate arcuate molding passageway for receiving molten metal. The endless belt is supported by rollers or wheels to move with the wheel and advance the metal through the molding passageway. Suitable cooling means are provided adjacent the passageway to cool and at least partially solidify the molten metal during its passage about the wheel. Molten metal is introduced into the molding passageway through an upper opening of the passageway formed at the point where the moving belt initially contacts the periphery of the wheel and the solidified metal in the form of a rod or bar is removed from the passageway through a lower opening formed at the point where the belt separates from the periphery of the wheel. The molten metal leaving the lower opening of the passageway in the shape of a rod of indefinite length is thereafter subjected to further conventional processing operations such as rolling, milling, stretching and the like.

At the start-up of such a continuous metal casting operation, and before the molten metal is initially poured into the passageway, it is a practice to temporarily block the passageway at a position along its length to prevent the molten metal from running out of the lower opening of the passageway before it has sufficiently solidified by cooling. For this purpose, a metal plug, generally a short length of metal bar, known as a "dummy bar," is physically wedged by force into an intermediate position of the passageway to contain the initially introduced molten metal therein until it has at least partially solidified. When the molten metal is sufficiently solidified, it becomes physically attached to the upper end of the plug or bar. The casting wheel is then set in rotation and the bar is manually pulled from its wedged position by an attached chain or extracting device to remove the bar and leading end of the solidified metal from the lower opening of the passageway. The dummy bar is separated from the end of the cast metal rod and the rod is then directed through the further processing operations.

It can be appreciated that the temporary plugging operation described presents many problems. Difficulty is encountered in physically wedging the dummy bar at the desired intermediate position of the passageway with sufficient force to insure that it will remain in place to support the molten metal until it has sufficiently solidified. Considerable effort is also required to physically dislodge the dummy bar from its wedged position as the casting wheel is set in rotation. The physical wedging of the bar in the molding passageway can also damage the surface of the peripheral groove of the casting wheel.

It is therefore an object of the present invention to provide a continuous metal casting apparatus employing an improved starting plug or dummy bar to initially contain the molten metal in the molding passageway.

It is a more specific object of the present invention to provide a continuous casting apparatus having additional means for positively retaining and readily releasing a starting bar or blocking member from an intermediate position of the casting passageway during initial start-up of the casting operation.

It is another object of the present invention to provide an improved method for continuously casting molten metal into a rod of indefinite length.

SUMMARY OF THE INVENTION

The above as well as other objects of the present invention are accomplished by the provision of apparatus for continuously casting molten metal into a rod or bar indefinite length wherein the casting apparatus is provided with additional means for positively retaining and releasing a blocking member from the passageway during initial start-up of the casting operation. In the specific embodiment hereindescribed, a blocking member of magnetizeable material is employed and electromagnetic means are provided adjacent the passageway to positively retain the magnetizeable blocking member in the desired position in the passageway, and to readily release the blocking member when molten metal has sufficiently soldified to proceed with the casting operation.

BRIEF DESCRIPTION OF THE DRAWINGS

Other objects, features and advantages of the present invention will become more apparent from the following detailed description of a preferred embodiment of the invention taken in conjunction with the accompanying drawings in which.

DESCRIPTION OF THE PREFERRED EMBODIMENT

Figure 1:
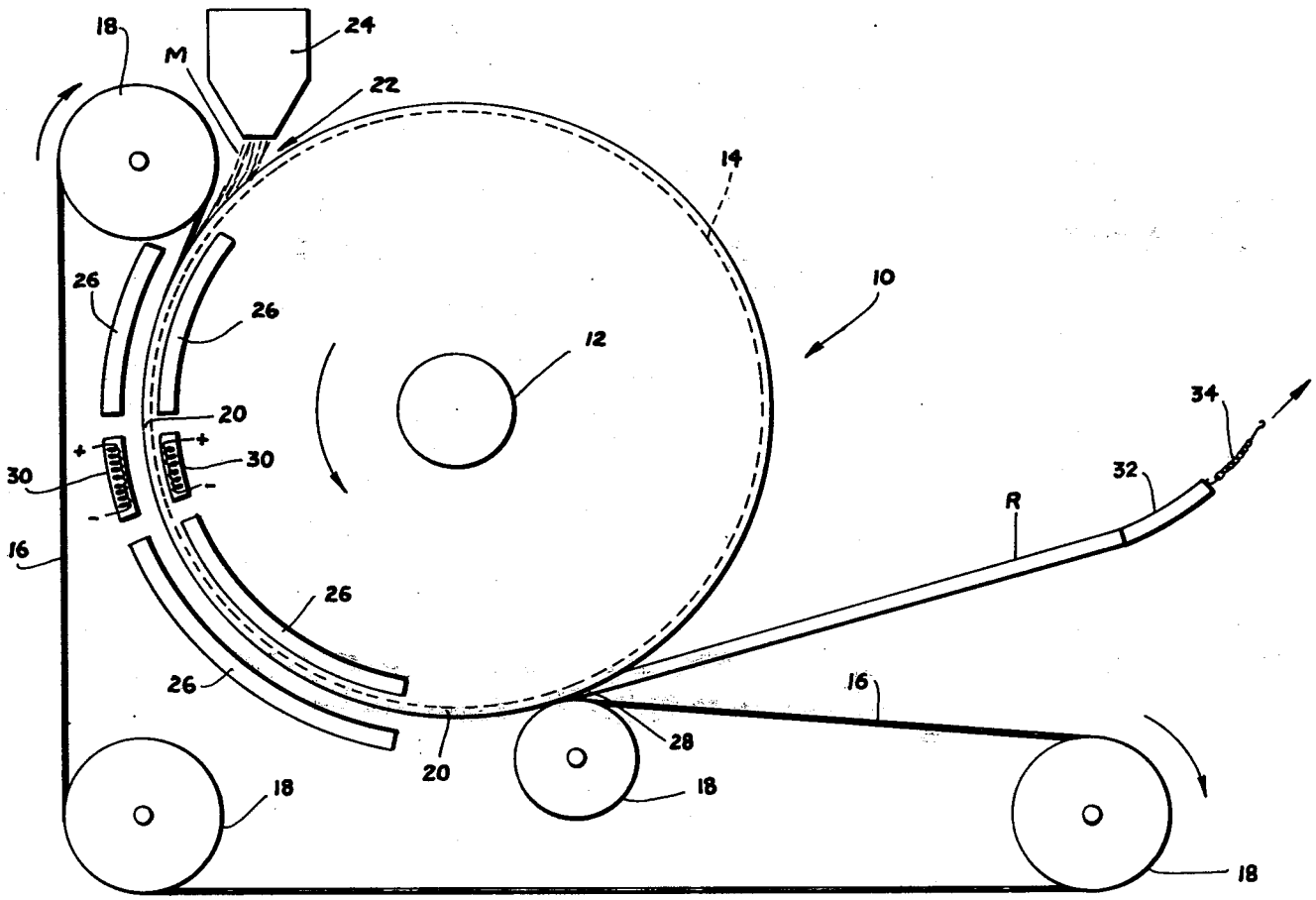
FIG. 1 is a schematic elevational view of a continuous casting machine constructed in accordance with the present invention.

Referring in detail to the embodiment chosen for illustration of the present invention, FIG. 1 is a schematic representation of a continuous metal casting machine comprising a casting wheel 10 suitably supported by a central shaft 12 for rotation by suitable motor means, not shown. The outer periphery of the wheel comprises a peripheral, outwardly facing annular groove 14 (shown in phantom lines in FIG. 1) formed of a material of suitable strength and other physical characteristics to withstand the temperatures and pressures required in the casting operation.

Positioned adjacent the peripheral surface of the wheel is an endless flexible belt or band 16 which is supported for movement on support wheels or rollers 18 arranged so as to position the band against a portion of the periphery of the wheel to overlie the annular groove along an extent thereof and form an arcuate molding passageway 20 of extended length. Positioned above the upper opening 22 of the passageway formed by the initial engagement of the belt and groove, is a source of molten metal, such as pouring pot 24 for delivering molten metal M into the molding passageway 20.

Suitably positioned along the passageway along its length are cooling means 26 which serve to cool the molten metal during its passage through the passageway and at least partially solidify the metal before its removal from the passageway. The belt 16 is directed out of engagement with the peripheral surface of the wheel to form a lower opening 28 of the passageway through which the at least partially solidified metal is removed in the form of a continuous rod R of indefinite length.

The specific length and cross-sectional shape of the arcuate molding passageway may be varied, depending upon the shape of the rod to be formed and the cooling capabilities of the cooling means surrounding the passageway. Typically, the cross-sectional configuration of the passageway may be trapezoidal, with the shorter parallel side of the trapezoid being formed by the innermost surface of the peripheral groove, to facilitate separation of the metal rod from the casting wheel after solidification. Such a casting wheel molding passageway configuration is disclosed in commonly-assigned Cofer et al U.S. Pat. No. 3,279,000, issued Oct. 18, 1966.

Figure 2:
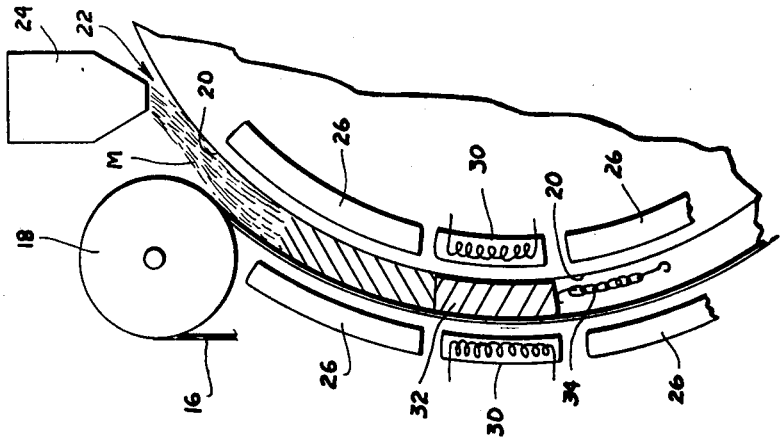
FIG. 2 is an enlarged elevation view of a portion of the molding passageway of the casting machine of FIG. 1, with the passageway shown in section, and showing the arrangement of electromagnetic retaining means surrounding the passageway to releasably secure a blocking member in the passageway at the beginning of the casting operation.

As best seen in FIG. 2, which is an enlarged, broken away, elevational view of a portion of the molding passageway 20, with the annular groove of the casting wheel shown in section, holding means comprising one or more electromagnets 30 are positioned externally of the passageway in close relation to the periphery of the casting wheel and belt, and at an intermediate position along the length of the passageway to create a magnetic force field of sufficient intensity to positionally support a magnetizable blocking member 32 at the start-up of the casting operation. To facilitate removal of the blocking member from the passageway and handling of the leading end of the solidified metal rod after start-up, the lower end of the member is provided with a retrieval chain 34. Electrical power is supplied to energize the electromagnets 30 at desired times from a suitable electrical supply source, not shown. The electromagnets are of conventional type capable of producing a sufficient electromagnetic force field to positively hold the magnetizable blocking member and accumulated molten metal above the member at the desired position in the passageway until the electromagnets are deenergized. It will be understood that the positioning of the electromagnets 30 shown in FIGS. 1 and 2 is diagrammatic, and that the electromagnets are in fact positioned relative to the casting wheel 10 and the blocking member 32 so as to urge the blocking member into the molding passageway 20 so long as the electromagnets are energized.

As seen, blocking member 32 has a longitudinal, arcuate shape which conforms to the arcuate shape of the passageway to permit its ready passage along the passageway during rotation of the casting wheel. The length of the blocking member may vary, depending upon the size and dimensions of the casting wheel and the molding passageway. The blocking member may be composed of various magnetizable materials, but preferably is composed of a material such as steel which has a high melting point relative to the metal being cast. The blocking member used with a typical casting wheel apparatus is preferably no longer than about ten inches in length, and is held by the electromagnets at an intermediate position about three to four feet from the upper opening of the molding passageway.

Although the electromagnetic holding device of the present invention may be employed with casting wheels constructed of various high strength materials, the electromagnetic device is ideally suited for use with casting wheels formed of copper or aluminum.

In operation of the casting apparatus of the present invention, and at initial start-up of the casting operation, the blocking member 32 is manually inserted into the upper opening 22 of the molding passageway. The electromagnets 30 are energized to retain the magnetizable blocking member at the desired intermediate position along the passageway. Thus positioned, molten metal is poured into the upper opening of the passageway and flows downwardly in the passageway until its passage is blocked by the blocking member. As the molten metal collects to fill the passageway and solidify by cooling, the leading end of the metal forms an attachment to the blocking member, and upon sufficient solidification of the metal, the continuous casting operation is commenced by initiation of movement of the casting wheel and endless band in a downward direction as indicated by the arrow in FIG. 1.

When the blocking member reaches the lower opening 28 of the passageway, it is removed by the extraction chain 34 and the blocking bar and attached metal rod directed into the further processing equipment of the casting operation. The blocking bar may be separated from the leading edge of the cast metal rod for reuse in a subsequent start-up operation. As the casting wheel is set in rotation, the electromagnets are simultaneously deenergized to release the magnetizable blocking member and permit its travel along the passageway to the lower opening. The chain of the blocking member is manually grasped or engaged by suitable tongs to pull the blocking member and attached leading edge of the molded solidified metal rod from the lower opening and to direct the rod into the further processing equipment of the casting operation. The blocking member can be readily broken away from the leading edge of the solidified metal rod at this point of the operation and set aside for subsequent reuse in a start-up operation.

Although the specific embodiment of the present invention has been shown and described to employ electromagnetic holding means for the blocking bar, it should be understood that other means for positively retaining and releasing the blocking bar from a desired location in the molding passageway may be employed. For example, means may be located externally of the passageway for temporarily restricting the cross-sectional dimensions of the passageway at a point intermediate its length, as by means applying a force to a portion of the overlying belt to press a localized area of the belt and hold the blocking bar at an intermediate position of the passageway.

Is is obvious that other variations may be made in the embodiment of the invention illustrated to positively retain and readily release the blocking member from the passageway during the initial start-up of the casting operation without departing from the scope of the following claims.

I claim

1. Apparatus for continuously casting molten metal into a rod of indefinite length comprising means defining a rotatable annular groove, means overlying said groove about at least a portion of its annular length to form an elongate, arcuate molding passageway for receiving molten metal, an upper opening is said passageway for introducing molten metal therein, means associated with said passageway for cooling molten metal therein, means for temporarily blocking said passageway at an intermediate position along its elongate length spaced from said opening to contain molten metal introduced therein prior to its solidification, and additional means in association with said passageway for releasably and frictionlessly retaining said blocking means in said passageway at said intermediate position along its length.

2. Apparatus as defined in claim 1 wherein said blocking means comprises a magnetizable material, and said releasably retaining means comprises means for creating a magnetic force field at said intermediate position in said passageway for retaining said magnetizable blocking means in said position in said passageway.

3. Apparatus as defined in claim 2 wherein said magnetic force field-creating means comprises electromagnet means.

4. Apparatus as defined in claim 2 wherein said blocking means is an elongate bar of magnetizable metal having a cross-sectional configuration conforming to the internal cross-sectional configuration of said passageway to facilitate its passage through and ready removal from said passageway upon release by said magnetic force field-creating means.

5. Apparatus as defined in claim 1 wherein said opening for receiving molten metal is at an upper elevation in said passageway from said intermediate position, and a second opening in said passageway more remote from said first named opening than said intermediate position for removing said blocking means from said passageway.

6. Apparatus as defined in claim 1 wherein said releasably retaining means is located externally of said elongate passageway.

7. An improved method for continuously casting molten metal into a rod of indefinite length by use of a rotatable casting wheel having an elongate, arcuate-shaped molding passageway for receiving and cooling molten metal during its movement through the passageway to at least partially solidify the same, comprising the steps of:

providing means adjacent an intermediate position in the passageway for frictionlessly but positively retaining a metal member for blocking the passageway at said position;

activating said retaining means;

inserting a metal blocking member into the passageway and passing the member therealong to said intermediate position for retention by said retaining means;

pouring molten metal into an upper opening of the passageway to be contained therein by said blocking member;

at least partially solidifying the molten metal in said passageway;

deactivating said retaining means to release the blocking member; and initiating rotation of said casting wheel to pass said blocking member and the at least partially solidified molten metal along the passageway and out of said passageway through a lower opening therein.

8. An improved method for continuously casting molten metal into a rod of indefinite length by use of a rotatable casting wheel having an elongate, arcuate-shaped molding passageway for receiving and cooling molten metal during its movement therethrough to at least partially solidify the same, the improvement wherein the continuous casting operation is initiated by:

creating a magnetic force field at an intermediate position in the passageway, introducing a magnetizable flow-blocking member into the passageway;

frictionlessly retaining the member in said magnetic force field at the intermediate position of the passageway;

pouring molten metal into an upper opening of the passageway to fill a portion of the passageway above said blocking member;

cooling the molten metal to at least partially solidify the metal;

removing said magnetic force field to release the blocking member from said intermediate position;

moving the blocking member and at least partially solidified metal along the passageway above the blocking member; and removing the blocking member and partially solidified metal from a lower opening of the passageway.

9. In apparatus for the continuous casting of molten metal including a wheel-band type continuous casting machine having an arcuate mold defined by a groove formed in the periphery of a rotatable casting wheel which is closed over a portion of its length by an endless flexible metal band, said mold having an inlet point and an outlet point, means for pouring molten metal into said mold at said inlet point thereof, means disposed at a point intermediate said inlet and outlet points for blocking a portion of said mold and preventing flow of the molten metal from said intermediate point to said outlet point prior to the initiation of rotation of said casting wheel, means for cooling the molten in said mold to at least partially solidify the molten metal into a cast bar, and means for extracting the cast bar from said mold;

the improvement comprising means operable externally of said mold for releasably frictionlessly retaining said blocking means in said mold whereby said blocking means is extractable from said mold in the same manner as the cast bar without interrupting the casting operation.

10. The combination of claim 9, wherein said blocking means is a plug having a cross-sectional shape conforming to the cross-sectional shape of said mold, and said plug is releasably retained in said mold without being wedged therein.

11. The combination of claim 9, wherein said blocking means comprises a plug formed of magnetizable material, and said releasably retaining means comprises means for creating a magnetic field at said intermediate point for retaining said plug at said intermediate point in said mold.

12. The combination of claim 11, wherein said means for creating a magnetic field are electromagnet means the deenergization of which releases said plug and permits ready removal thereof from said mold.

* * * * *